US007066897B2

(12) United States Patent
Huang

(10) Patent No.: US 7,066,897 B2
(45) Date of Patent: Jun. 27, 2006

(54) PAD ASSEMBLY FOR USE WITH SWINGING EXERCISER

(76) Inventor: Chin-Hsin Huang, P.O. Box 487, Chang-Hua City (TW) 500

( * ) Notice: Subject to any disclaimer, the term of this patent is extended or adjusted under 35 U.S.C. 154(b) by 580 days.

(21) Appl. No.: 10/431,447

(22) Filed: May 8, 2003

(65) Prior Publication Data

US 2004/0082887 A1 Apr. 29, 2004

(30) Foreign Application Priority Data

Oct. 28, 2002 (TW) ..... 91217389 U

(51) Int. Cl.
*A61H 1/02* (2006.01)

(52) U.S. Cl. ..... 601/15; 601/35; 5/655.3; 5/655.5; 5/654; 5/681

(58) Field of Classification Search ..... 601/15, 601/27, 29, 31, 34, 35, 55, 148–151; 602/13; 128/845, 847, DIG. 20; 5/650, 653, 654, 5/655.3, 655.4, 681, 706, 709, 710–713, 5/922, 941; 297/284.3, 284.6, 452.25, 452.41, 297/464

See application file for complete search history.

(56) References Cited

U.S. PATENT DOCUMENTS

| | | | | |
|---|---|---|---|---|
| 4,949,712 | A * | 8/1990 | Torii | 601/35 |
| 5,395,162 | A * | 3/1995 | Jay et al. | 297/452.41 |
| 5,906,586 | A * | 5/1999 | Graham | 128/845 |
| 6,159,172 | A * | 12/2000 | Gray et al. | 601/149 |
| 6,491,650 | B1 * | 12/2002 | Huang | 601/35 |
| 6,553,591 | B1 * | 4/2003 | Motosko | 5/655.5 |

* cited by examiner

*Primary Examiner*—Quang D. Thanh

(57) ABSTRACT

A pad assembly includes an air-filled base having an air-filled first bladder and an air-filled second bladder connected to a top of the base. A first liquid-filled part is rested in a recessed area in the first bladder and a second liquid-filled part is rested in a recessed area in the second bladder. The first part and the second part respectively support a user's body and hip. The base is supported on a frame and a swinging exerciser is put on the frame so that the user lies on the bladders and the feet is rested on the swinging exerciser.

4 Claims, 3 Drawing Sheets

PAD ASSEMBLY FOR USE WITH SWINGING EXERCISER

FIELD OF THE INVENTION

The present invention relates to a pad assembly including a air-filled base and two liquid-filled parts which respectively support user's body and hip and two feet of the user is rested on a swinging exerciser.

BACKGROUND OF THE INVENTION

A conventional air-filled pad is generally composed of a plurality of hollow tubular parts which are filled with air so that these tubular parts can be assembled as a large area of pad. The air is compressible so that when a user lies on the pad, the heavier upper body applies a larger load to the pad than the lower body so that the air is squeezed toward the lower body and the head of the user is lower than the feet. The user feels uncomfortable because the blood flows to the head which is located lower than the feet. The conventional pad cannot provide a good sleep quality to the users.

The present invention intends to provide a pad assembly which includes a air-filled base and two liquid-filled pads which are rested on two recesses on the base and respectively support the user's body and hip. The feet of the user are swung by a swinging exerciser so that the user's body receives cool and comfortable movement.

SUMMARY OF THE INVENTION

In accordance with one aspect of the present invention, there is provided a pad assembly which comprises a base having a first bladder and a second bladder connected to a top of the base. Each of the base, the first bladder and the second bladder has an air inlet of their own. A first part is rested in a recessed area in the first bladder and a second part is rested in a recessed area in the second bladder. Each of the first part and the second part is filled with liquid.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
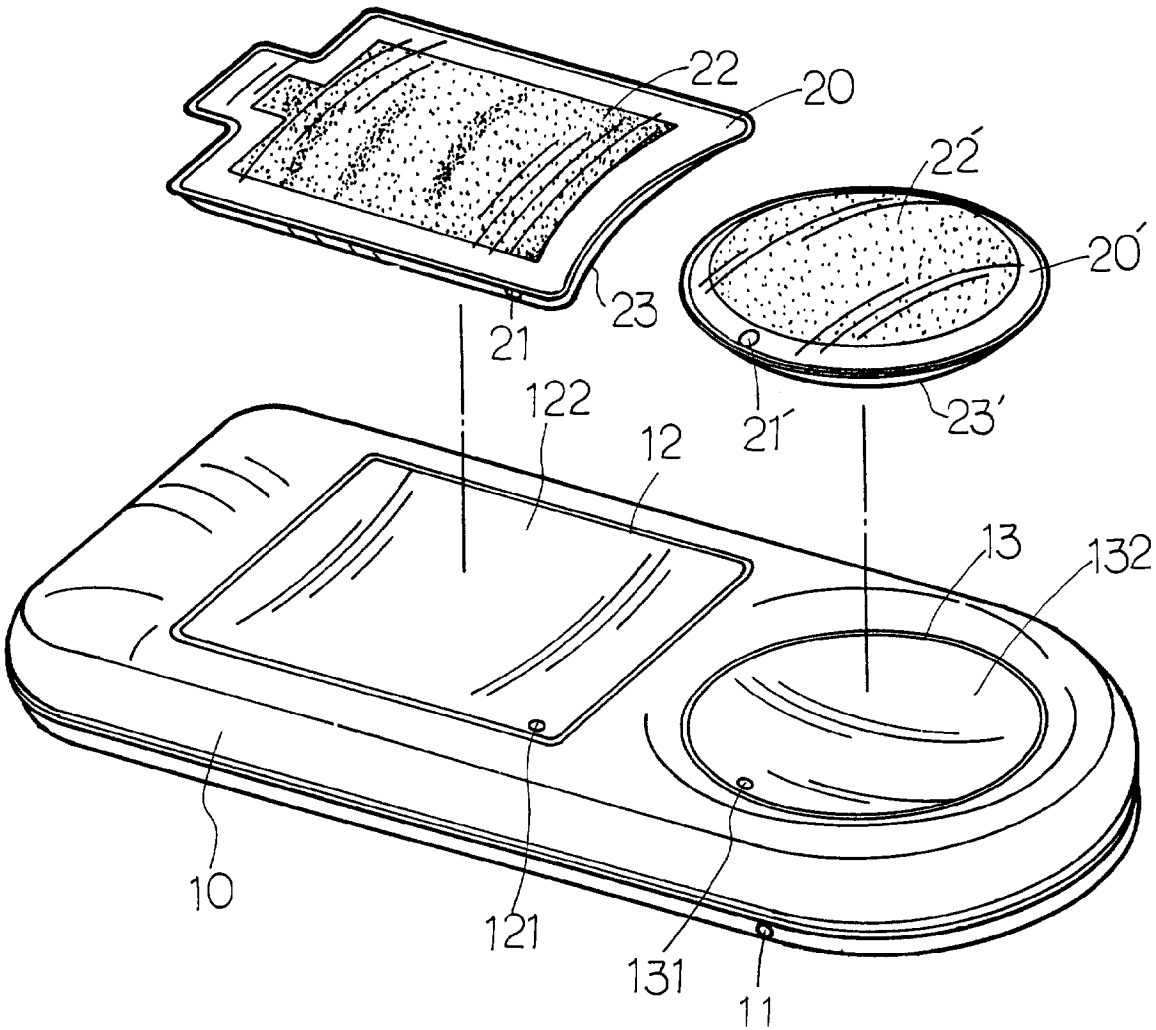
FIG. 1 is an exploded view to show the base and two parts of the present invention.
Figure 2:
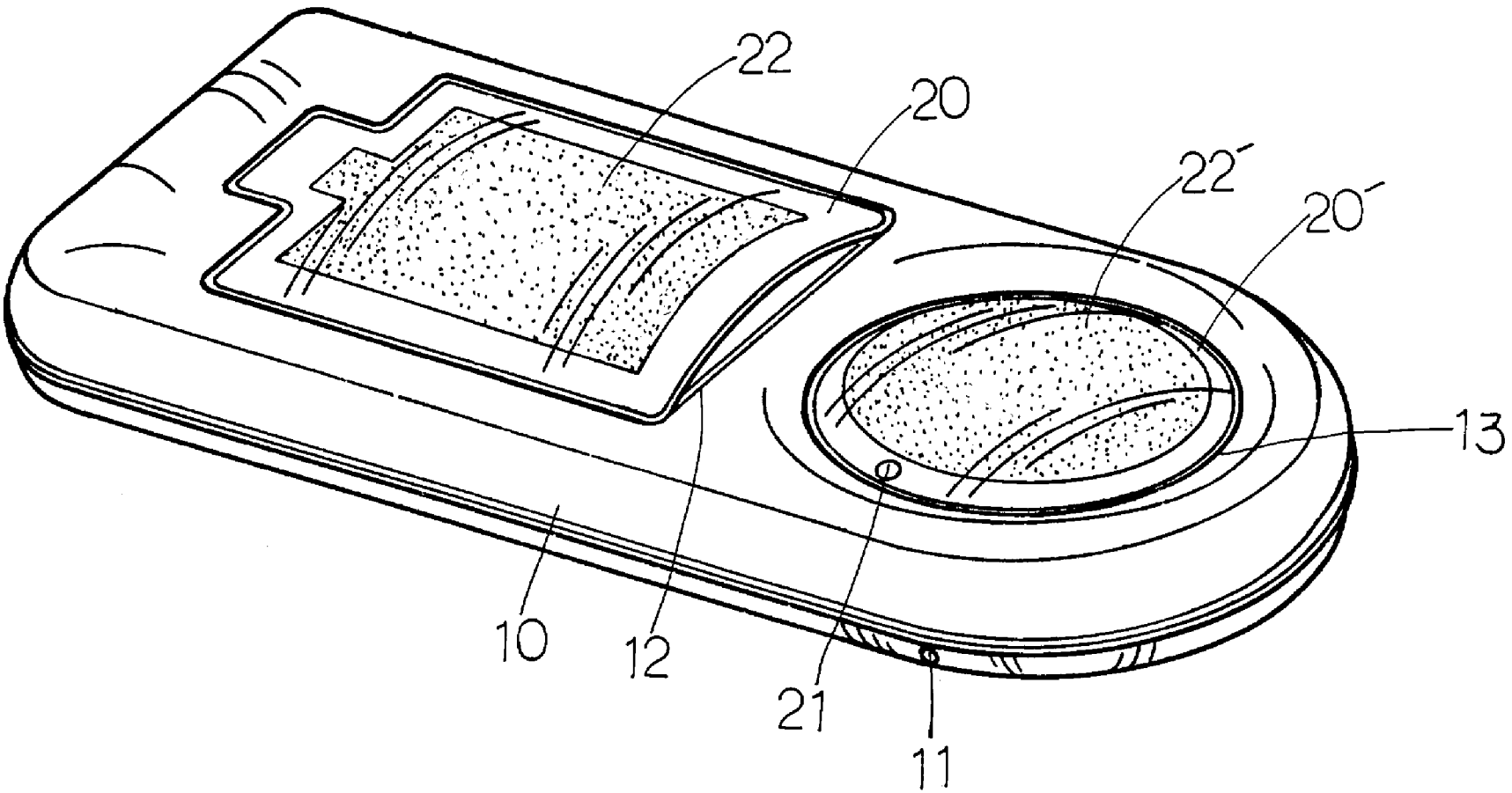
FIG. 2 is a perspective view to show the two parts are put on the base of the present invention.

Referring to FIGS. 1 and 2, the pad assembly of the present invention comprises a base 10 having a first bladder 12 and a second bladder 13 connected to a top of the base 10. Each of the base 10, the first bladder 12 and the second bladder 13 has an inlet 11/121/131 of their own so as to fill air therein. The length of the fist bladder 12 is longer than that of the second bladder 13 and the air filled in the two bladders 12, 13 are controlled to form a recessed area 122/132 in a top of each of the first bladder 12 and the second bladder 13.

A first part 20 is rested in the recessed area 122 in the first bladder 12 and a second part 20' rested in the recessed area 132 in the second bladder 12. Each of the first part 20 and the second part 20' has a liquid inlet 21/21' so as to fill liquid therein. A plurality of far infra-red plates 22, 22' are connected to the first part 20 and the second part 20', and each of the first part 20 and the second part 20' further includes anti-slippery surface 23/23' so as to be well positioned in the recessed areas 122, 132.

Figure 3:
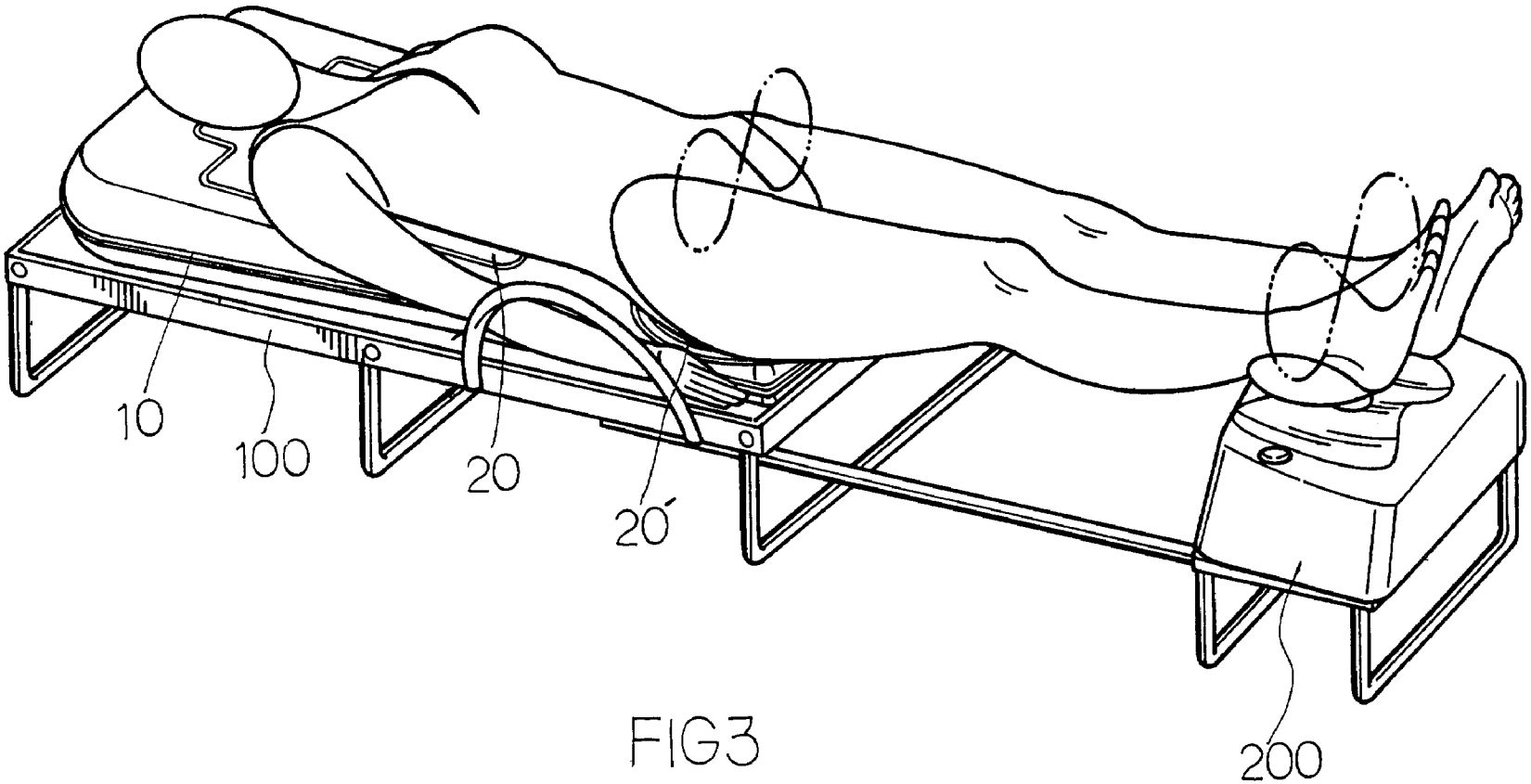
FIG. 3 shows the base is put on a frame and a user lies on the two parts and the feet of the user are rested on the swinging exerciser.

As shown in FIG. 3, the base 10 is put on a frame 100 which has an extended section so that a swinging exerciser 20*o* is put on the extended section which is located in an opposite end of the base 10 on the frame 10. A user lies on the base 10 and the two parts 20, 20', wherein the first part 20 supports the body of the user and the second part 20' supports the hip of the user. The two feet are rested on the swinging exerciser 200 so that the swinging waves the body of the user and the cool two parts 20, 20' provide the user a good and cozy feeling. The far infra-red plates 22, 22' enhance the circulation of blood of the user.

While we have shown and described the embodiment in accordance with the present invention, it should be clear to those skilled in the art that further embodiments may be made without departing from the scope of the present invention.

What is claimed is:

1. A pad assembly comprising:

a base having a first bladder and a second bladder connected to a top of the base, each of the base, the first bladder and the second bladder being an air-filled member and having an inlet of their own, and a first part rested in a recessed area in the first bladder and a second part rested in a recessed area in the second bladder, each of the first part and the second part being filled with liquid.

2. The pad assembly as claimed in claim 1 further comprising far infra-red plates connected to the first part and the second part.

3. A combination of pad assembly and swinging exerciser, comprising:

a base having a first bladder and a second bladder connected to a top of the base, each of the base, the first bladder and the second bladder being an air-filled member and having an inlet of their own;

a frame on which the base is put;

a first part rested in a recessed area in the first bladder and a second part rested in a recessed area in the second bladder, each of the first part and the second part being filled with liquid, and a swinging exerciser put on an end of the frame and located opposite to the base on the frame.

4. The pad assembly as claimed in claim 3 further comprising far infra-red plates connected to the first part and the second part.

* * * * *